US005970889A

United States Patent [19]

Shaffer et al.

[11] Patent Number: 5,970,889

[45] Date of Patent: Oct. 26, 1999

[54] STEEL SHELL SAFE WITH SNAP-IN RESIN LINER

[75] Inventors: Douglas E. Shaffer, Victor; Leland E. Emery, Avon, both of N.Y.

[73] Assignee: John D. Brush & Co., Inc., Rochester, N.Y.

[21] Appl. No.: 08/923,523

[22] Filed: Sep. 4, 1997

[51] Int. Cl.[6] ..... E04G 1/026

[52] U.S. Cl. ..... 109/65; 109/84

[58] Field of Search ..... 109/84, 59 R, 109/64, 65, 74–83

[56] References Cited

U.S. PATENT DOCUMENTS

| | | | |
|---|---|---|---|
| 900,696 | 10/1908 | Baum | 109/85 |
| 1,547,721 | 7/1925 | Bellamore | 109/65 |
| 1,678,471 | 7/1928 | Hunter | 109/84 |
| 2,622,547 | 12/1952 | Fugelstad | 109/65 |
| 3,095,838 | 7/1963 | Paulos et al. | 109/85 X |
| 3,408,966 | 11/1968 | Gartner | 109/74 |
| 4,048,926 | 9/1977 | Brush, Jr. et al. | 109/65 |
| 4,422,386 | 12/1983 | Carpenter | 109/59 R |
| 4,574,454 | 3/1986 | Dyson | 109/84 X |
| 4,688,493 | 8/1987 | Brush, Jr. et al. | 109/65 |
| 4,721,227 | 1/1988 | Hughes et al. | 109/84 X |
| 4,893,397 | 1/1990 | Hughes | 109/65 X |
| 5,069,358 | 12/1991 | Avery, Jr. | 109/84 X |
| 5,295,447 | 3/1994 | Robbins et al. | 109/65 |

*Primary Examiner*—Suzanne Dino Barrett
*Attorney, Agent, or Firm*—Eugene Stephens & Associates

[57] ABSTRACT

An insulated steel shell safe has a lip extending inward around an inner periphery of a door opening; and a molded resin liner, inserted into the steel shell through the door opening, is connected to the lip to form an interior of the safe. The liner has a face flange seated against the front face of the lip and outwardly extending ribs engaging a rear face of the lip. This supports the liner within the shell by engagement of the face flange and the ribs with the lip while insulation material is poured through a back wall of the shell into the space between the shell and the liner.

22 Claims, 4 Drawing Sheets

STEEL SHELL SAFE WITH SNAP-IN RESIN LINER

TECHNICAL FIELD

Manufacture of fire-resistant safes with steel outer shells and resin liners.

BACKGROUND

A resin liner for a safe with a steel outer shell takes advantage of desirable characteristics of both materials. A resin liner makes the safe's interior versatile and moisture resistant, and a steel outer shell adds strength and durability. U.S. Pat. Nos. 4,048,926 and 3,408,966 have recognized the possibility of such a combination; and more recently, the assignee of this application has manufactured steel shell safes with resin liners. The steel shells were formed without back panels, and the resin liners were inserted from the rear to seat against the inside of front frames of the steel shells. The rear steel panels were then assembled to the backs of the safes, and insulation was poured into spaces between the resin liners and the steel outer shells.

All these suggestions have left room for improvement. For example, assembling a back panel to a steel shell after a liner is in place involved interconnections between the back panel and the liner and proved to be more expensive than welding the back panel to the shell as the rest of the shell is fabricated. Also, problems have persisted with insulation material leaking from a junction between the liner and the steel shell. The present invention aims to solve these problems and reduce assembly cost while taking advantage of the properties of a steel outer shell and a resin liner for a fire-resistant safe.

SUMMARY OF THE INVENTION

By this invention, a steel outer shell with a door opening is fully constructed beforehand, preferably by welding elements together; and an injection molded resin liner is then inserted through the door opening and snapped into a predetermined position within the steel shell. The positioning of the liner within the shell is preferably accomplished by forming the steel shell with an inwardly extending lip around an inner periphery of a door opening and forming the resin liner with a face flange that seats against the front face of the lip when the liner is pressed into the steel shell. The liner also has outwardly extending ribs that snap over and engage a rear face of the lip so that the liner is supported within the shell by the engagement of its face flange and its ribs with opposite faces of the lip extending inward around the door opening. The face flange can be sealed to the front face of the lip to prevent leakage of insulation material; and supporting the liner by its inner connection with the lip is secure enough so that insulation can be poured through the rear wall of the shell into the space between the liner and the shell, without requiring any additional attachment between the liner and the shell.

DRAWINGS

DETAILED DESCRIPTION

Figure 1:
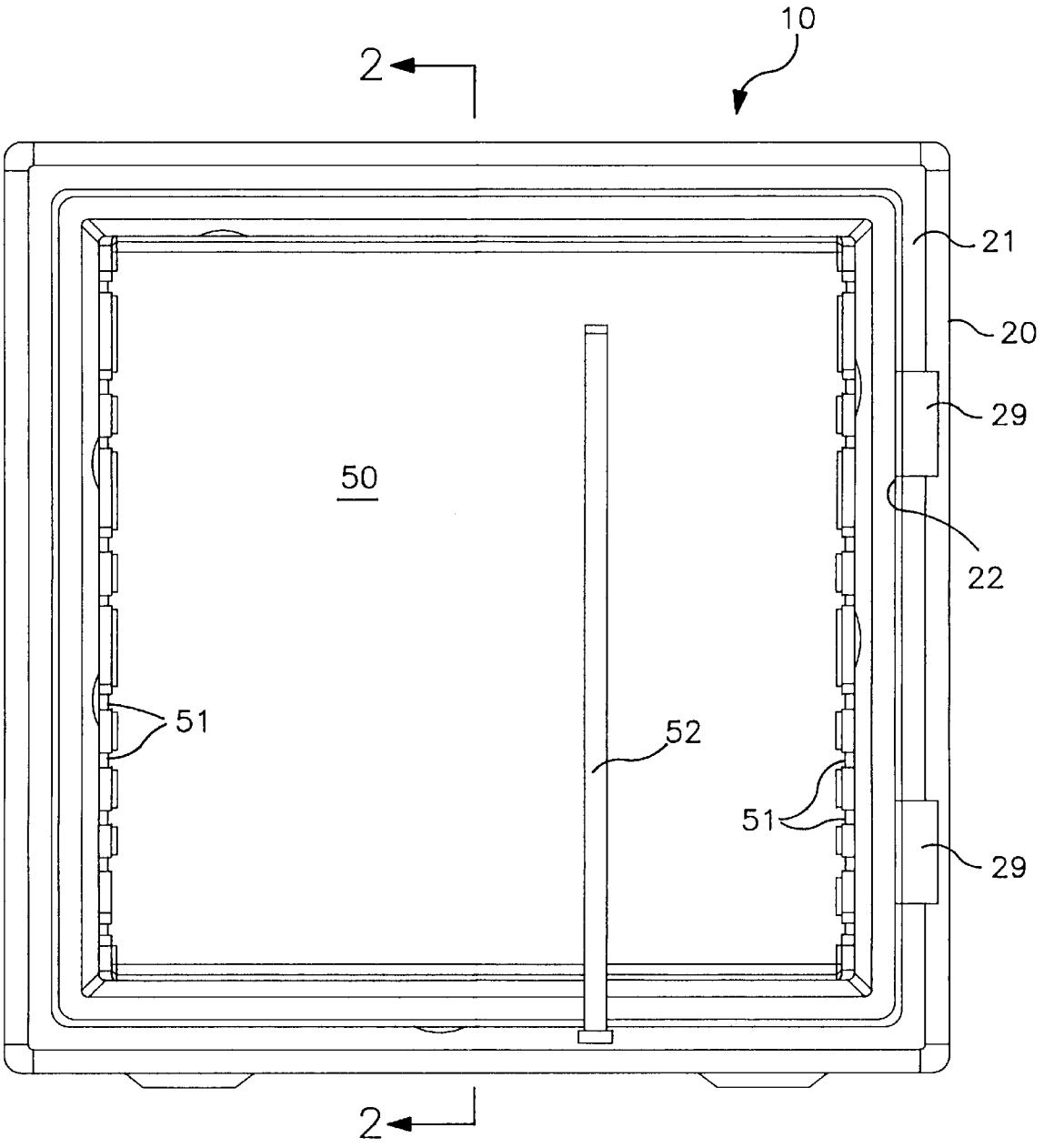
FIG. 1 is a front elevational view of a preferred embodiment of the inventive steel shell safe with a snap-in resin liner, before a front door, drawers, or shelves are assembled.

The safe 10 of FIG. 1 represents one preferred embodiment of many possible configurations of steel shell safes with snap-in liners. Safe 10 has a steel shell 20 and a snap-in resin liner 50; and in the view of FIG. 1, shell 20 has a front frame 21 around a door opening 22 through which the injection molded resin liner 50 is inserted.

Figure 6:
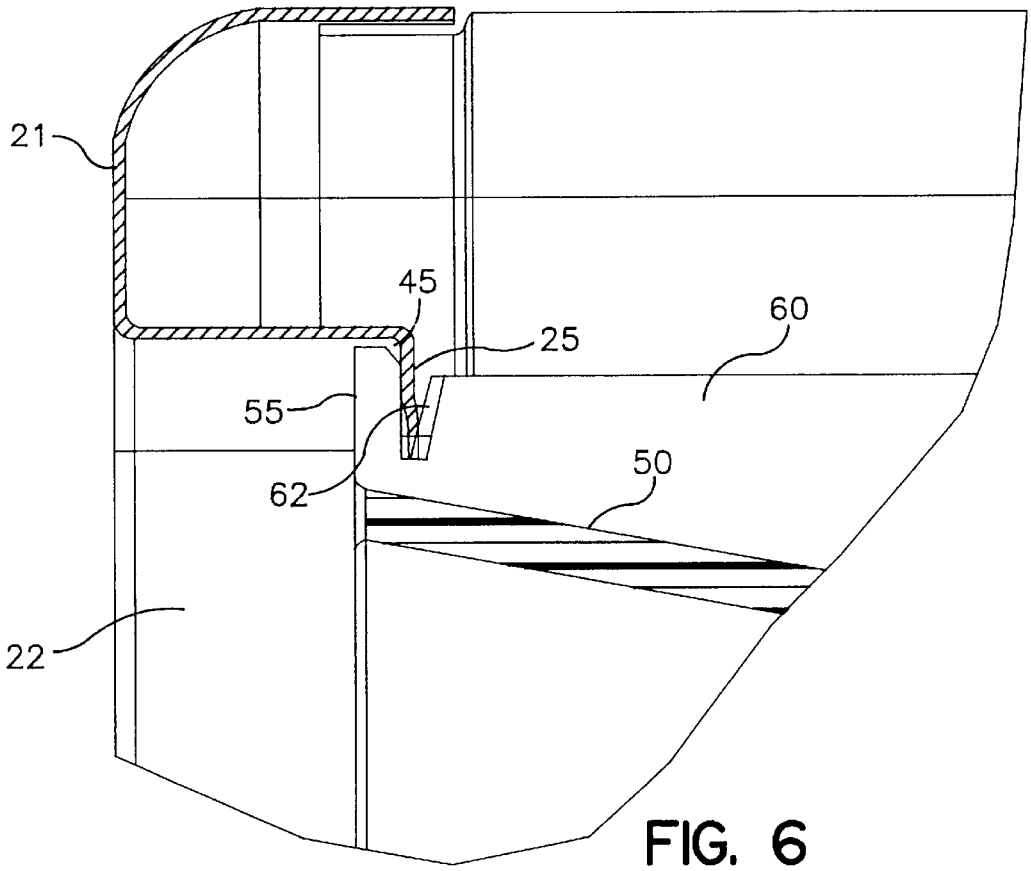
FIG. 6 is an enlarged detail of the upper left corner of FIG. 2.
Figure 5:
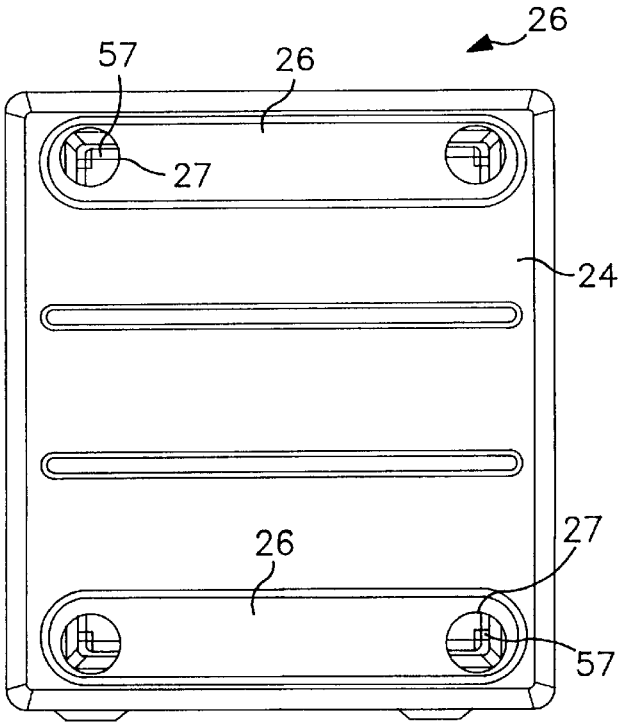
FIG. 5 is a rear view of the assembled shell and liner of FIGS. 1 and 2.

The interconnection between liner 50 and shell 20 occurs around a lip 25 that turns inward around door opening 22 of front frame 21, as best shown in FIG. 6. A face flange 55 around the open front region 54 of liner 50 seats against and engages lip 25 when liner 50 is fully inserted into shell 20. Lip 25, by its engagement with face flange 55, limits the insertion of liner 50 into shell 20. The engagement of flange 55 with lip 25 also affords a region for sealing liner 50 to shell 20 by means of a sealant 45 deposited on the front face of lip 25.

Liner 50 also has ribs 60 that extend outward around the forward open region 54 of liner 50. Front opening region 54 of liner 50 lies within door opening 22 and extends rearwardly of face flange 55 where it includes molded bolt cups 56 for receiving live bolts that are extendible from a door (not shown). Ribs 60 extend from a forward region close to face flange 55 rearwardly beyond bolt cups 56. In other words, ribs 60 extend both forwardly and rearwardly of a plane intersecting bolt cups 56, and rearward edges 61 of ribs 60 are inclined outwardly in a rearward-to-forward direction.

A back or rearward region 57 of liner 50 is dimensioned to fit inside of lip 25 as liner 50 is inserted into shell 20. The inclined rear surfaces 61 of ribs 60 engage lip 25 as liner 50 is inserted through door opening 22; and as liner insertion advances, ribs 60 deform resilient liner walls inwardly as ribs 60 pass through the opening provided inside of lip 25.

When liner 50 is fully inserted into shell 20, forward edges 62 of ribs 60 snap over lip 25 to engage a rear face of lip 25 and prevent retraction of liner 50 from shell 20. In effect, liner 50 is then snapped into place and held in position by the engagement of its flange 55 with a front face of lip 25 and by engagement of its ribs 60 with a rear face of lip 25. This also brings face flange 55 into engagement with a sealant 45 that is preferably predeposited on a front face of lip 25.

Figure 2:
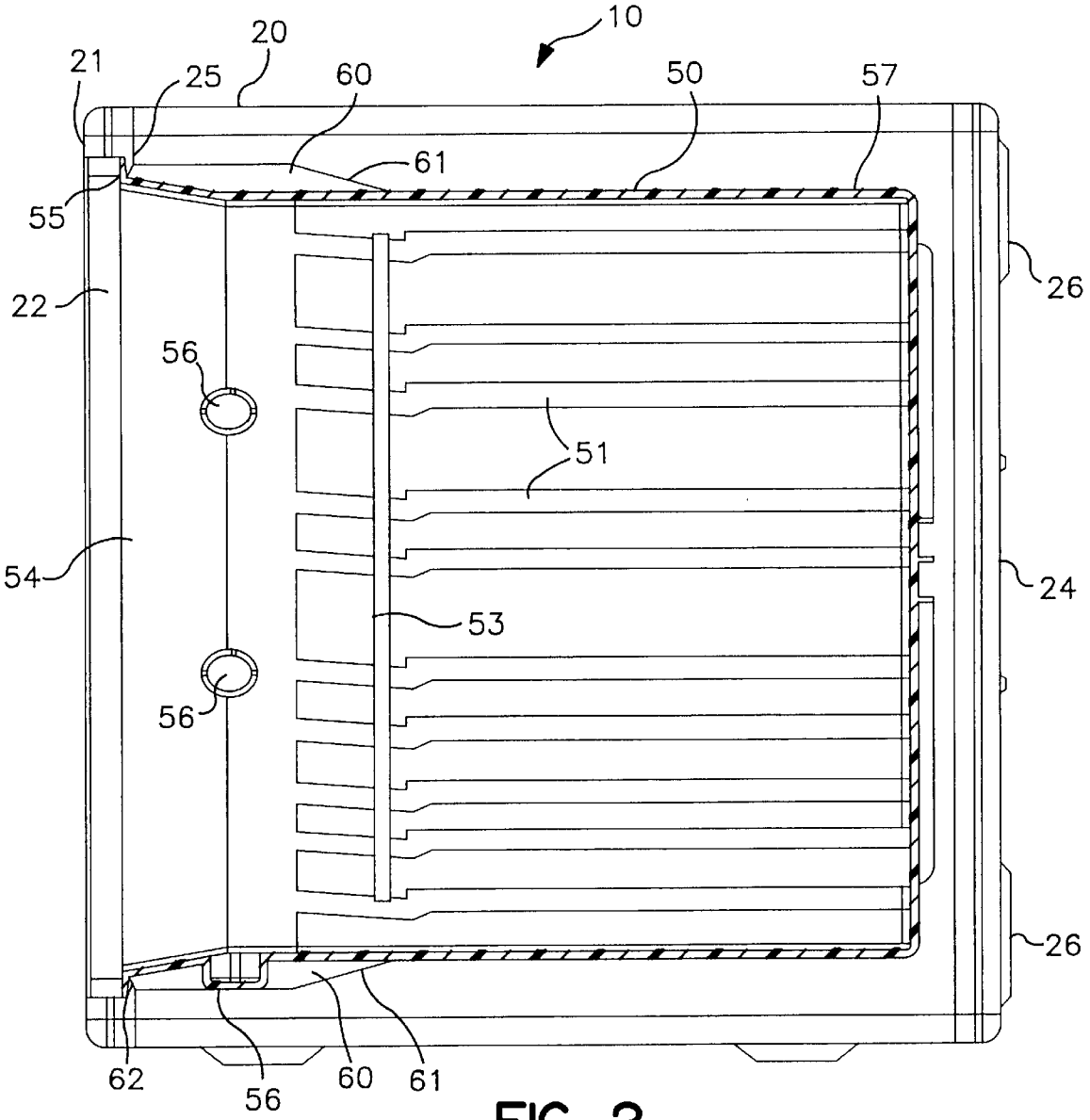
FIG. 2 is a cross-sectional view of the safe of FIG. 1, taken along the line 2—2 thereof.
Figure 3:
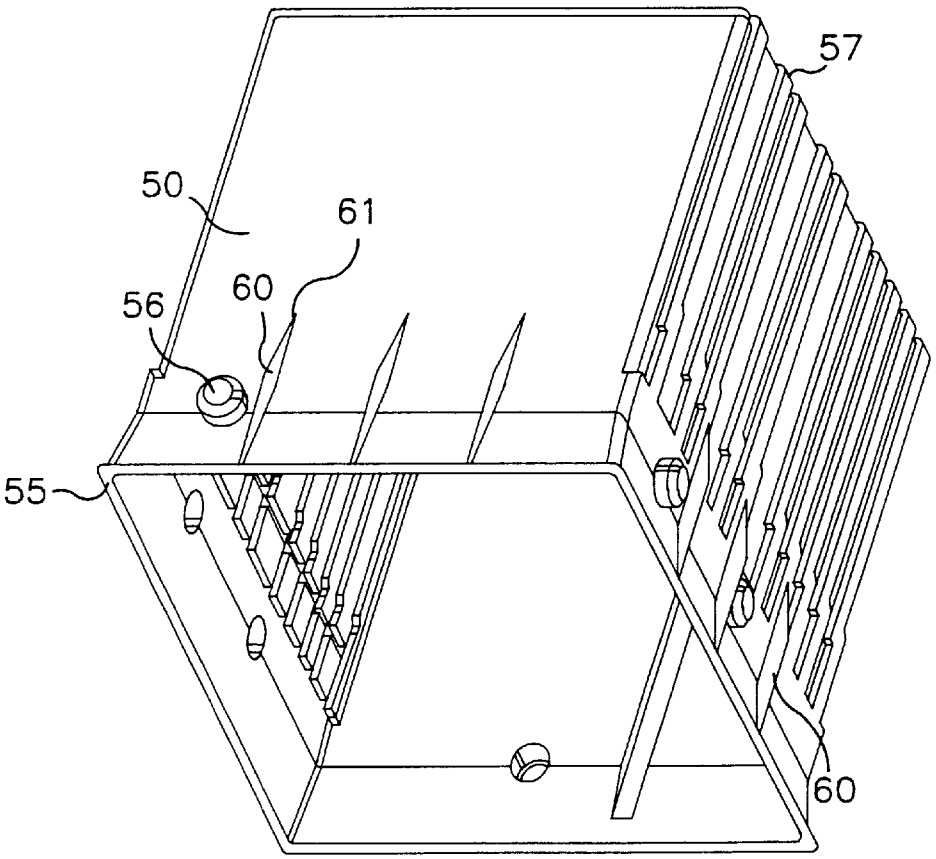
FIG. 3 is an isometric view of the molded resin liner for the safe of FIGS. 1 and 2.
Figure 4:
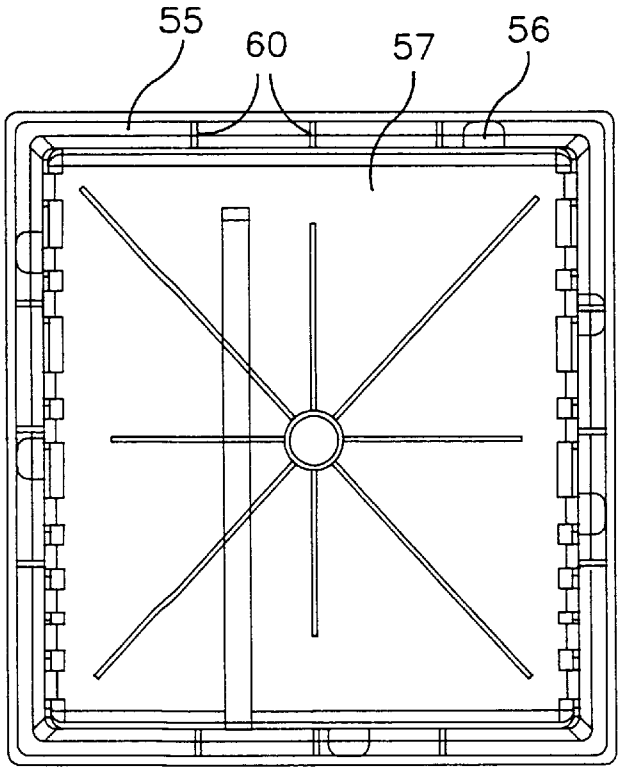
FIG. 4 is a rear view of the liner of FIG. 3.

The interior of liner 50 is preferably molded with side slots 51 for supporting shelves or drawers and a bottom and back wall slot 52 for supporting an upright divider. As shown in FIG. 2, the interior of liner 50 also includes a vertical side groove 53 that can be used for locking in place a drawer otherwise supported in a pair of slots 51. One of the advantages of using resin material for liner 50 is the multiple accommodations that can be molded in for shelves, drawers, and dividers. This allows safes to be sold in many different configurations.

By using the engagement of liner 50 with lip 25, no other interconnection between liner 50 and shell 20 is necessary. A rear wall or back 24 of shell 20 is welded to the walls of shell 20 before liner 50 is inserted into shell 20, and no interconnection is required between the liner back region 57 and shell back wall 24. Although liner 50 is securely mounted in its assembled relationship within shell 20, a fixture, preferably engaging the liner front and door frame, can extend into the interior of liner 50 to support the liner walls against bowing inward when insulation is poured into the space between the liner and shell.

Back wall 24 has a pair of filling reservoirs 26, each of which has a pair of filling openings 27. Each filling opening 27 affords a region for pouring insulation material into the space between liner 50 and shell 20, while these parts are positioned with frame 21 and door opening 22 facing downward. Reservoirs 26 are preferably raised from the general plane of back wall 24 to vent the filling process and to accommodate extra insulation material, especially at the upper rear corner of safe 10 where extra insulation can be important for fire resistance. Any number of the available filling openings 27 can be used, depending on the insulation material and the filling equipment being used. Although filling openings can also be arranged at different locations on back panel 24, arranging filling openings 27 at corner regions of back wall 24 allows insulation material to be flowed into safe 10 in a symmetrically balanced pattern that does not tend to push liner 50 out of its centrally aligned position within shell 20.

After safe 10 is filled with insulation material, filling openings 27 are covered with caps (not shown) and the insulation material is allowed to set. With the preferably sealed engagement of face flange 55 against the front face of lip 25, insulation material can be prevented from leaking around the joint between liner 50 and shell 20. This is desirable to avoid any clean up of leaked insulation material.

Final assembly of safe 10 requires mounting a door on hinges 29 and arranging whatever shelves, dividers, or drawers are desired within the interior of liner 50. This method of assembling a steel shell safe allows shell 24 to be precoated with an enamel finish that is not marred by liner assembly, insulation pouring, or insulation leakage.

We claim:

1. A safe having a steel shell that is enclosed except for a rear filling opening and door opening in a front frame, the safe comprising:

a. an inturned lip of the frame extending inward in a plane of the door opening;

b. a resin liner forming an interior of the safe, the liner having a face flange overlapping and seated against a front face of the lip so that engagement of the face flange with the lip limits insertion of the liner into the shell;

c. a forward region of the liner having outwardly extending ribs extending beyond an inside dimension of the lip;

d. forward ends of the ribs terminating against a rear face of the lip to block extraction of the liner from the shell; and e. the engagement of the lip by the face flange and the ribs cooperating to hold the liner in a predetermined position within the shell so that the liner is spaced from the shell to accommodate insulation material.

2. The safe of claim 1 including a seal between the face flange of the liner and the front face of the lip.

3. The safe of claim 1 wherein the liner includes live bolt cups formed around an inner periphery of the forward region, and the ribs extend across a plane intersecting the live bolt cups.

4. A method of making the safe of claim 1 including pressing the liner into the shell so that the ribs flex the liner wall inward and then snap over the lip.

5. The method of claim 4 including filling insulation material into the space between the liner and the shell, by pouring the insulation through a reservoir opening in a rear wall of the shell.

6. The method of claim 5 including pouring insulation through at least one reservoir opening at an upper region of the rear wall.

7. The safe of claim 1 wherein the rear filling opening is a reservoir opening formed in a rear wall of the shell for flowing insulation material into the space between the shell and the liner.

8. The safe of claim 7 wherein the reservoir opening is in an upper region of the rear wall to thicken the insulation material at the upper rear of the safe.

9. A steel shell safe comprising:

a. a steel shell formed to be enclosed except for a rear filling opening and front door opening formed with a lip extending inwardly around an inner periphery of the door opening;

b. a resin liner molded to fit within the steel shell and leave a space between the liner and the steel shell for insulation material; and c. the liner being positioned within the shell so that forward facing ends of exterior ribs formed on the liner engage a rear face of the lip, and a face flange of the liner overlaps and seats against a front face of the lip.

10. The safe of claim 9 including live bolt cups formed in a forward region of an inside of the liner and the ribs being formed to extend across a plane intersecting the live bolt cups.

11. The safe of claim 9 including insulation flowed into a reservoir formed around the filling opening in an upper region of the rear wall of the shell.

12. The safe of claim 9 wherein the face flange of the liner is sealed to the front face of the lip.

13. A method of making the safe of claim 9 by inserting the liner through the door opening so that the exterior ribs on the liner engage the lip and flex the liner walls inwardly as the liner is pressed through the lip opening.

14. In an insulated steel shell safe, the improvement comprising:

a. the steel shell having a lip extending inward around an inner periphery of a door opening;

b. a molded resin liner connected to the lip and forming an interior of the safe;

c. the liner having a face flange seated against a front face of the lip;

d. the liner having outwardly extending ribs engaging a rear face of the lip; and e. the liner being supported within the shell by the engagement of the face flange and the ribs with the lip.

15. The improvement of claim 14 including a sealant arranged between the face flange of the liner and the front face of the lip.

16. The improvement of claim 14 including live bolt cups formed in the liner in a plane spaced rearwardly of the face flange, and the ribs extending from forward of the live bolt plane to rearward of the live bolt plane.

17. The improvement of claim 14 wherein the ribs have outer edges that are inclined outwardly in a rearward-to-forward direction.

18. The improvement of claim 14 including an insulation filling opening formed in a rear wall of the shell.

19. The improvement of claim 18 including a reservoir around a filling opening arranged in an upper region of the rear wall.

20. A method of making the safe of claim 14 including pressing the liner into the shell so that the ribs flex the liner wall inward and then snap over the lip.

21. The method of claim 20 including filling insulation material into the space between the liner and the shell, by pouring the insulation through a reservoir opening in a rear wall of the shell.

22. The method of claim 21 including pouring insulation through at least one reservoir opening at an upper region of the rear wall.

* * * * *